US010583342B1

(12) United States Patent
Williams

(10) Patent No.: US 10,583,342 B1
(45) Date of Patent: Mar. 10, 2020

(54) BASKETBALL TRAINING DEVICE

(71) Applicant: Paul L. Williams, Columbia, SC (US)

(72) Inventor: Paul L. Williams, Columbia, SC (US)

( * ) Notice: Subject to any disclaimer, the term of this patent is extended or adjusted under 35 U.S.C. 154(b) by 0 days.

(21) Appl. No.: 16/554,865

(22) Filed: Aug. 29, 2019

(51) Int. Cl.

| | |
|---|---|
| ***A63B 69/00*** | (2006.01) |
| ***A63B 63/08*** | (2006.01) |
| *A63B 24/00* | (2006.01) |
| *A63B 69/20* | (2006.01) |
| *A63B 69/32* | (2006.01) |

(52) U.S. Cl.
CPC ..... *A63B 69/0071* (2013.01); *A63B 63/083* (2013.01); *A63B 24/0021* (2013.01); *A63B 69/0079* (2013.01); *A63B 69/201* (2013.01); *A63B 69/205* (2013.01); *A63B 69/32* (2013.01)

(58) Field of Classification Search
CPC ... A63B 69/0071; A63B 63/083; A63B 63/08; A63B 2063/001; A63B 69/40; A63B 2069/401; A63B 69/201; A63B 69/205; A63B 69/0079; A63B 67/10; A63B 69/20; A63B 24/0021; A63G 9/00
USPC ..... 473/422, 447–449, 472, 479–489, 473/506–508, 575, 576; 482/86–90; 273/348, 331, 317.3, 393
See application file for complete search history.

(56) References Cited

U.S. PATENT DOCUMENTS 124,588 A * 3/1872 Kehoe ..... A63B 69/201 482/86
489,750 A * 1/1893 Medart ..... A63B 69/205 482/87
571,874 A * 11/1896 Frazier ..... A63B 69/205 482/87
602,517 A * 4/1898 McFadden ..... A63B 69/205 482/87
662,045 A * 11/1900 Whitely ..... A63B 69/205 482/87
689,344 A * 12/1901 Yoerger ..... A63B 69/205 482/87
716,163 A * 12/1902 Yoerger ..... A63B 69/205 482/87
755,689 A * 3/1904 McFadden ..... A63B 69/205 482/87
773,167 A * 10/1904 Spink ..... A63B 67/10 473/442
822,789 A * 6/1906 Twiss ..... A63F 9/02 273/340
990,430 A * 4/1911 Fanning ..... A63B 69/205 482/87
1,694,044 A * 12/1928 Thompson ..... A63B 69/0079 482/87
2,694,572 A * 11/1954 Crisp ..... A63B 63/083 473/449
2,708,576 A * 5/1955 Verkuilen ..... A63B 63/083 473/448
2,710,189 A * 6/1955 Carroll ..... A63B 63/083 473/449
3,105,683 A * 10/1963 Kimbrell ..... A63B 69/40 473/449

(Continued)

*Primary Examiner* — Mitra Aryanpour
(74) *Attorney, Agent, or Firm* — Melissa B. Neely

(57) ABSTRACT

The present invention relates to a training device for basketball consisting of a support member that is mounted on the ceiling and a target member suspended below the support member. The player lays on the floor below the device and tosses a basketball at the target member.

6 Claims, 3 Drawing Sheets

(56) References Cited

U.S. PATENT DOCUMENTS 3,173,687 A * 3/1965 Hair ..... A63B 63/083 473/449
3,348,840 A * 10/1967 Dix ..... A63B 63/083 473/449
3,471,150 A * 10/1969 Kaerwer ..... A63B 69/40 473/449
3,776,551 A * 12/1973 Schaller ..... A63B 69/0079 473/575
3,910,574 A * 10/1975 Voltz ..... A63B 63/083 473/449
4,003,572 A * 1/1977 Harvey ..... A63B 69/0079 473/429
4,257,589 A * 3/1981 Outlaw ..... A63B 21/1636 473/569
4,627,611 A * 12/1986 Kauffman ..... A63B 69/205 482/87
4,712,510 A * 12/1987 Tae-Ho ..... A01K 15/025 473/575
5,048,822 A * 9/1991 Murphy ..... A63B 69/201 482/7
5,135,233 A * 8/1992 Leas ..... A63B 67/10 473/575
5,893,807 A * 4/1999 Aikens ..... A63B 63/00 473/422
6,244,993 B1 * 6/2001 Dunn ..... A63B 69/201 482/83
6,544,099 B2 * 4/2003 Shafik ..... A63H 5/00 273/454
6,572,496 B1 * 6/2003 Brown ..... A63B 69/0071 473/449
6,692,385 B2 * 2/2004 Walker, Jr. ..... A63B 69/0071 473/447
6,702,292 B2 * 3/2004 Takowsky ..... A63B 67/002 473/353
6,740,012 B1 * 5/2004 Olszewski ..... A63B 69/20 482/83
6,887,171 B2 * 5/2005 Hochfeld ..... A63B 63/08 473/470
7,011,311 B2 * 3/2006 Hochfeld ..... A63B 63/08 473/470
7,311,618 B1 * 12/2007 Reed ..... A63B 63/083 473/447
7,850,535 B2 * 12/2010 Noble ..... A63B 24/0021 273/331
8,029,422 B2 * 10/2011 Strong ..... A63B 69/004 482/83
8,721,505 B2 * 5/2014 Conarty ..... A63B 69/20 482/89
8,814,728 B2 * 8/2014 Safran ..... A63B 69/004 473/422
2003/0224879 A1 * 12/2003 Hansberry ..... A63B 69/0002 473/423
2004/0254036 A1 * 12/2004 Smith ..... A63B 69/0079 473/423
2006/0172826 A1 * 8/2006 De Vries ..... A63B 69/0071 473/447
2008/0026917 A1 * 1/2008 Campana ..... A63B 69/34 482/83
2016/0023078 A1 * 1/2016 Haselrig ..... A63B 69/004 482/87
2016/0045802 A1 * 2/2016 Holland ..... A63B 69/0071 473/448
2016/0059102 A1 * 3/2016 Williamson ..... A63B 71/0619 482/8
2016/0129326 A1 * 5/2016 Ozkaya ..... A63B 21/4043 482/83
2016/0166910 A1 * 6/2016 Adams, Jr. ..... A63B 69/205 482/86
2017/0100652 A1 * 4/2017 Bowers ..... A63B 63/00 473/449

* cited by examiner

BASKETBALL TRAINING DEVICE

CROSS REFERENCE TO RELATED APPLICATIONS

Not Applicable

STATEMENT REGARDING FEDERALLY SPONSORED RESEARCH OR DEVELOPMENT

This invention was not made by an agency of the United States Government nor under a contract with an agency of the United States Government.

THE NAME OF THE PARTIES TO JOINT RESEARCH AGREEMENT

Not Applicable.

INCORPORATION BY REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable

SEQUENCE LISTING

Not Applicable

BACKGROUND OF THE INVENTION

Field of the Invention

The game of basketball was created in 1891 to condition young athletes during cold months and as a less injury-prone sport than football. The first public game was played on Mar. 11, 1892 in Springfield Mass. The sport of basketball quickly spread with the first collegiate games played in 1893 and the foundation of a professional league in 1898. Basketball entered the Olympics as an official medal even in the 1936 Summer games in Berlin, Germany with 23 nations in the competition.

The present invention is a training aid for developing control and accuracy in basketball passing.

The invention helps enhance the shooting form of the player by making the wrist flex with the extension of the arm and push of the shoulder from a ninety degree angle. The return of the ball via gravity aids in the player developing hand-eye coordination and reaction time. The invention is designed to be used by one person and can be used in the home.

Description of Related Art

US Patent Application Publication 2017/0100652 (Surface Mounted Ball and Net Device) discloses a device for individual or group game play. The invention consists of a base which can be attached to a ceiling or wall and an attached intermediate structure through which a ball or other object can be thrown into.

U.S. Pat. Nos. 7,011,131 and 6,887,171 related to a game for one or more players in which an device with two or more openings for receiving a ball can be mounted on the ceiling. The players lay on the floor below the device and throw balls at the device.

U.S. Pat. Nos. 7,942,763, 7,713,149 and 7,427,244 disclose basketball training devices. In each case the device is designed to be used with a basketball hoop and/or backboard. The devices disclosed in these patents are not designed to be ceiling mounted.

U.S. Pat. No. 6,702,292 discloses a game system where the user lays on the floor and throws ball upward where a sensor array determines the parameters of the ball's flight path and provides them to the user.

BRIEF SUMMARY OF THE INVENTION

The present invention relates to a device to assist with the development of a basketball's player accuracy and control of passing the ball. It also helps develop the player's muscles used in passing the ball. The invention helps enhance the shooting form of the player by making the wrist flex with the extension of the arm and push of the shoulder from a ninety degree angle. The return of the ball via gravity aids in the player developing hand-eye coordination and reaction time. The invention is designed to be used by one person and can be utilized in the home.

The invention consists of a support member, typically in the shape of a ring, which is affixed to a room's ceiling. A target member, typically spherical in shape, is suspended below the support and is attached to the support with two or more elastic straps. The player lays on his back on the floor underneath the invention and tosses a basketball upwards at the target. Gravity returns the ball to the player.

DETAILED DESCRIPTION OF THE INVENTION

Figure 1:
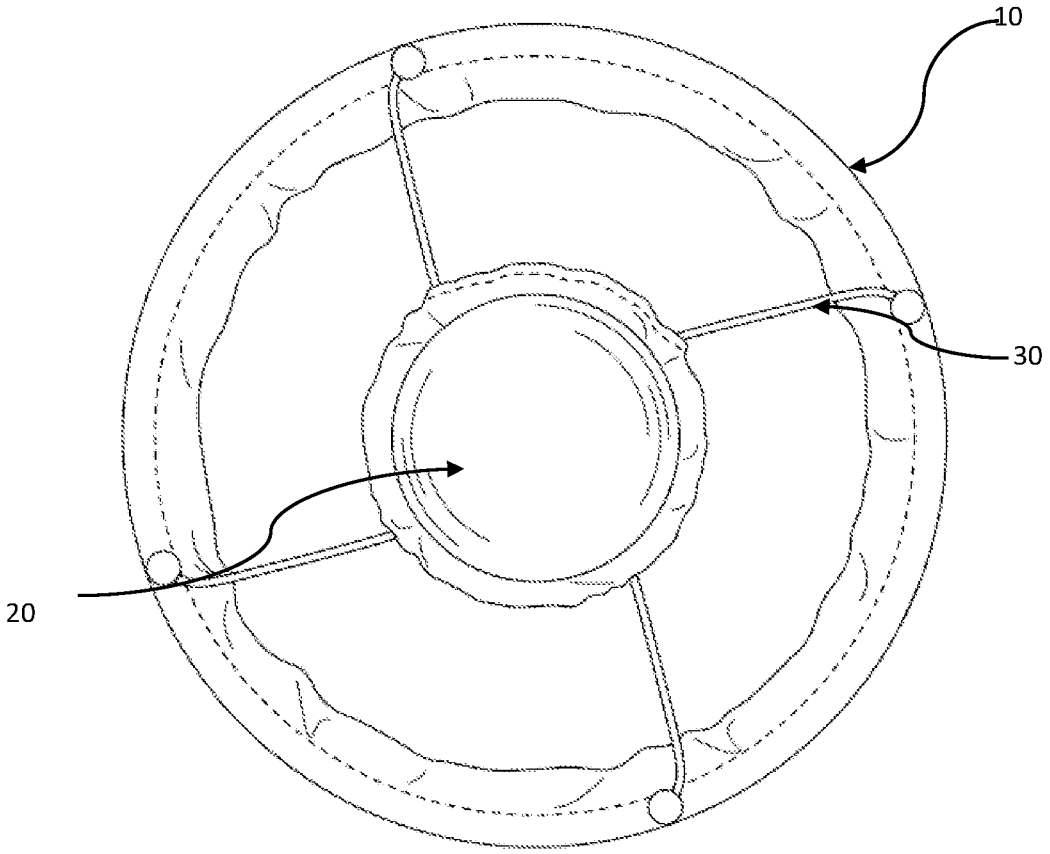
FIG. 1 is a bottom view of the invention showing the support member (10), the target member (20) and the attachment straps (30).

The present invention relates to an in-home training aid for basketball players. It consists of a support member (10) that is affixed to the ceiling and a target member (20) suspended below the support using elastic straps (30). To use the device, the player lays on the floor underneath the device and tosses a basketball at the suspended target member. Gravity returns the ball to the player.

The support member (10) is typically circular in shape, i.e. a ring but can be other shapes including but not limited to a square, rectangle and/or triangle. One embodiment of the support member (10) consists of a ring constructed from metallic wire covered with cloth or leather. In other embodiments, the support member may be molded plastic, foam, or wood with or without a cloth or leather covering. The ring shaped embodiment of the support member (10) is between six to twelve inches in diameter.

The target member (20) is typically spherical in shape with a typical diameter between two to six inches but is not limited to this shape and size. The preferred embodiment of the target member (20) is a sphere constructed of fabric stuffed with synthetic pillow stuffing. The target member (20) may also be constructed of foam in a spherical shape with or without a fabric covering.

The target member (20) is suspended below the ceiling mounted support (10) by four equal length straps (30). In the preferred embodiment of the invention, the straps (30) are between five and six inches in length and are elastic. The target member (20) may have an attachment edge (21) of fabric positioned around the circumference of the target member (20), this is for ease of attachment of the straps (10) connecting the target member (20) to the support member (10). The attachment straps (30) may be attached to the target member (20) and support member (10) in a number of ways including but not limited to adhesive, sewing thread, metal staples and tied through eyelet holes located on the target member (20) and support member (10).

Potential CPC patent classification for this invention: A36B—Apparatus for Physical Training, Gymnastics, Swimming, Climbing, or Fencing; Ball Games; Training Equipment.

Figure 2:
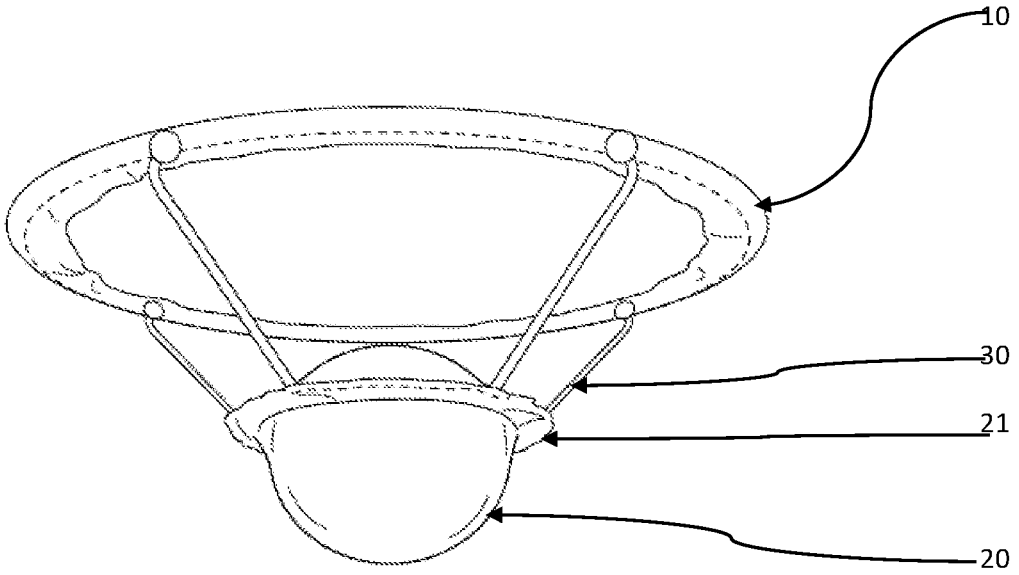
FIG. 2 is a side view of the invention showing the support member (10), the target member (20) with attachment edge (21) and the attachment straps (30).
Figure 3:
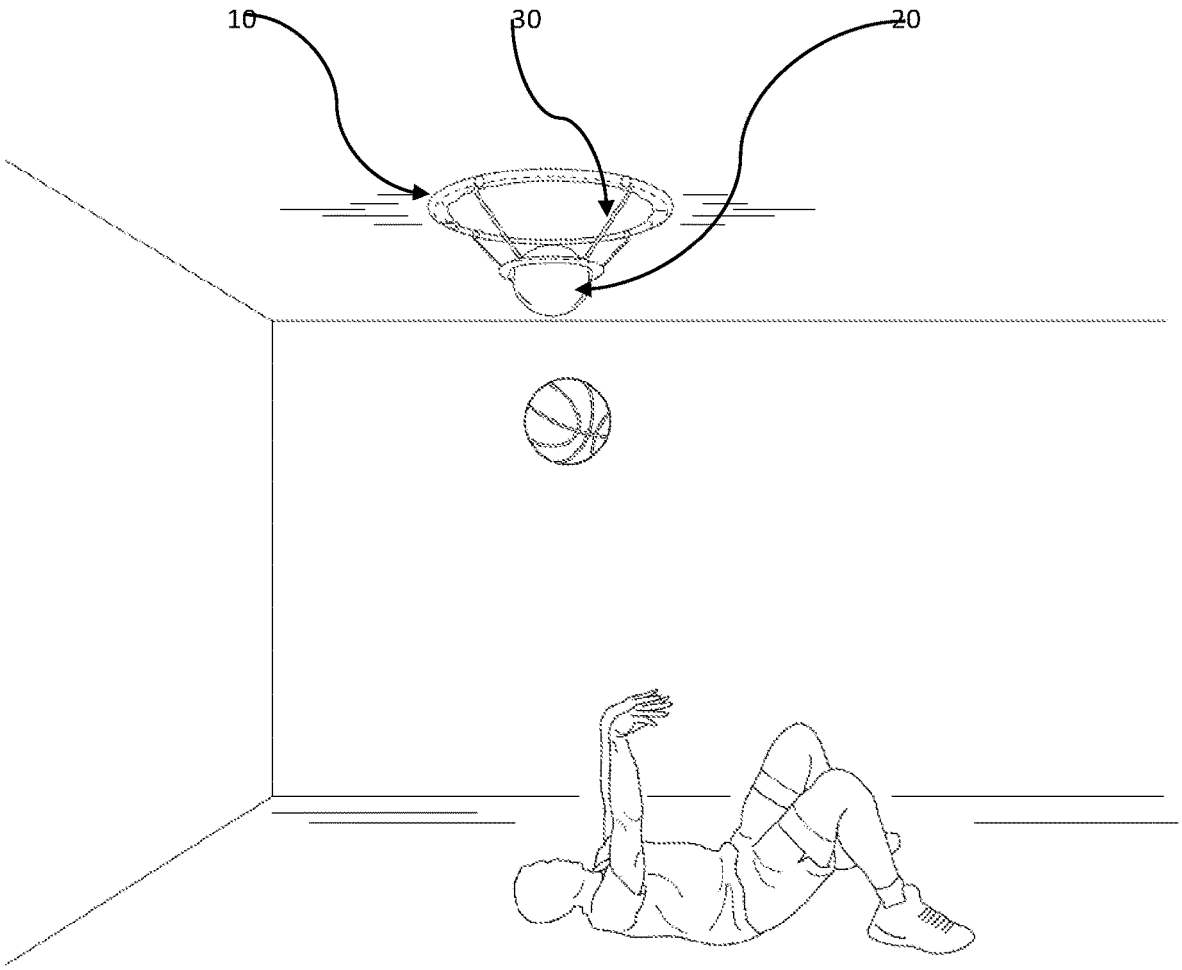
FIG. 3 demonstrates the invention in use with a player laying on the floor throwing the ball towards the target member (20) suspended below the ceiling mounted support member (10).

The present invention described above and illustrated in FIGS. 1 through 3 is visualized as the preferred embodiment of the invention. It is envisioned that this invention may be embodied in many different forms and should not be construed as limited to the embodiments set forth herein. It will be understood by those skilled in the art that changes in forms and details may be made without departing from the spirit and scope of the present application. It is therefore intended that the present invention not be limited to the exact forms and details described and illustrated herein but falls within the scope of the appended claims.

The terminology used herein is for describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a stricture or feature that is disposed "adjacent" another feature may have portions that overlap or underlie the adjacent feature.

The invention claimed is:

1. A basketball training device comprising:

a support member having a shape for attachment to a ceiling of a room;

a spherical-shaped target member suspended below said support member, wherein said spherical-shaped target member is filled with stuffing material; and two or more spaced-apart elastic straps;

wherein said spherical-shaped target member is suspended from said support member by said two or more spaced-apart elastic straps.

2. The training device of claim 1, wherein said support member is circular in shape and has a diameter in the range of 6 to 12 inches.

3. The training device of claim 1, wherein said spherical-shaped target member is about 2 to 6 inches in diameter.

4. The training device of claim 1, wherein said support member is circular, rectangular or triangular in shape.

5. The training device of claim 1, wherein said support member is constructed of one of a metallic wire, plastic, foam or wood and is covered in cloth or leather.

6. The training device of claim 1, wherein said spherical-shaped target member is constructed of cloth or leather and the stuffing material is one of a pillow stuffing or foam.

* * * * *